US005535742A

United States Patent [19]

Neff

[11] Patent Number: 5,535,742

[45] Date of Patent: Jul. 16, 1996

[54] COOKTOP

[75] Inventor: Paul J. Neff, Mississauga, Canada

[73] Assignee: Neff Kitchen Manfacturers Limited, Brampton, Canada

[21] Appl. No.: 408,808

[22] Filed: Mar. 23, 1995

[51] Int. Cl.[6] ..... F24C 15/10

[52] U.S. Cl. ..... 126/211; 126/214 D

[58] Field of Search ..... 126/211, 42, 37 R, 126/39 R, 214 R, 299 R, 214 D

[56] References Cited

U.S. PATENT DOCUMENTS

| | | | |
|---|---|---|---|
| 916,657 | 3/1909 | Bihler | 126/211 |
| 1,370,113 | 3/1921 | Janusonis | 126/211 |
| 2,560,959 | 7/1951 | Klein | 126/214 R |
| 3,142,295 | 7/1964 | Blee | 126/37 R |
| 3,513,826 | 5/1970 | Hellmuth | 126/211 |
| 4,157,705 | 6/1979 | Caan | 126/214 D |
| 4,562,827 | 1/1986 | Cerola | 126/299 R |
| 5,158,068 | 10/1992 | Pickering | 126/215 |

*Primary Examiner*—James C. Yeung
*Attorney, Agent, or Firm*—Bereskin & Parr

[57] ABSTRACT

A cooktop for a food cooking apparatus includes a cooking surface having a number of heating units, wherein the cooking surface is located within a well defined by the surface and surrounded by walls on all four sides. The front wall at least prevents direct access to the cooking surface by a child standing on a floor surface in front of the apparatus, as a safety measure. The walls also serve to prevent a saucepan or other cooking utensil being pulled off the cooking surface, or accidentally dislodged. Also, any spilled food or the like will be constrained within the well and will not spill off the cooktop.

3 Claims, 2 Drawing Sheets

FIG. 3.
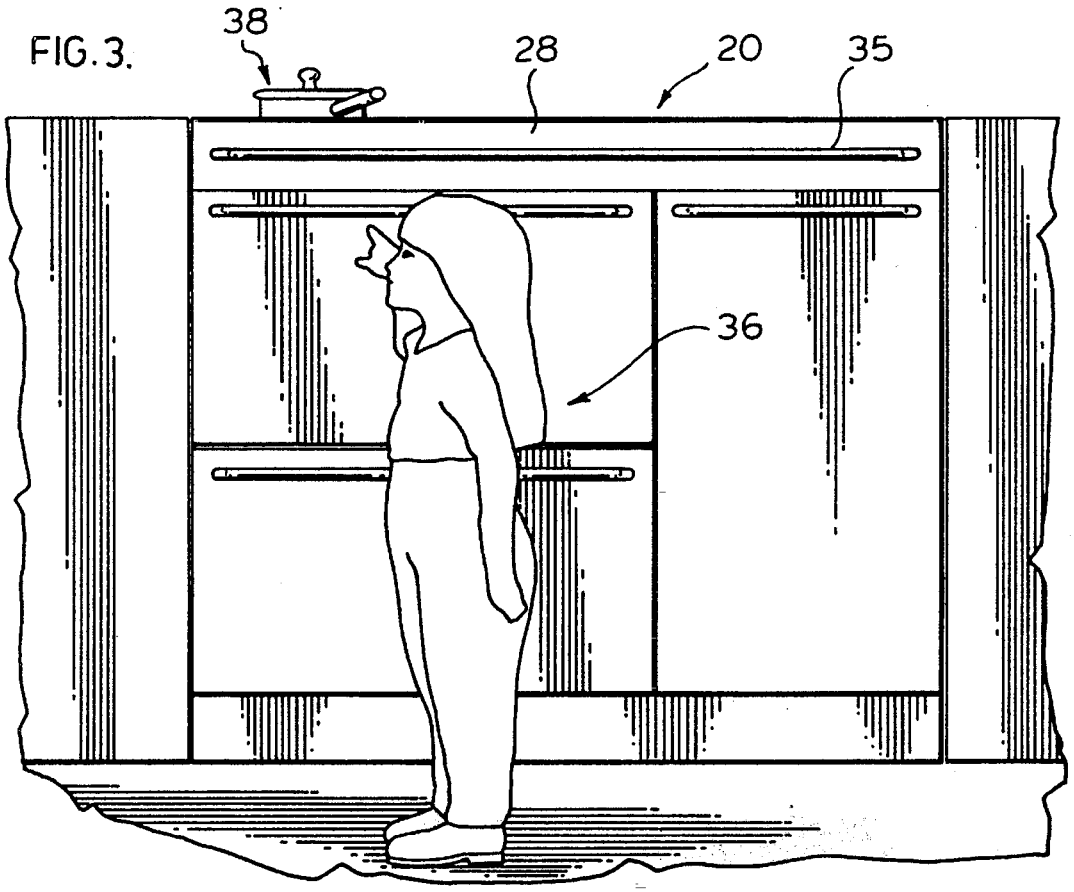
FIG. 4.
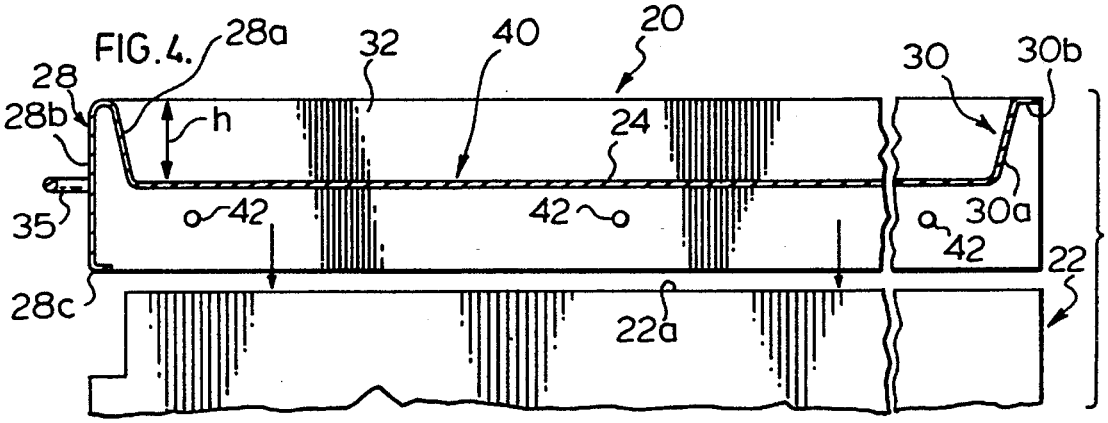
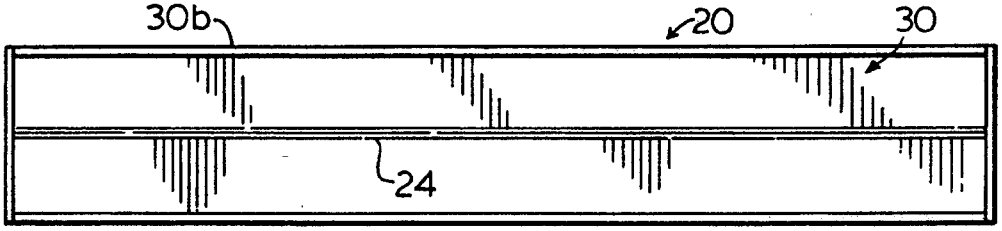
FIG. 5.

COOKTOP

FIELD OF THE INVENTION

This invention relates generally to food cooking apparatus and is concerned more particularly with a cooktop having a cooking surface provided with a number of heating units for saucepans or other utensils. It is to be understood that the term "cooktop" is to be interpreted broadly as including not only self-contained units that are mounted in or on a counter top, but also cooktops that form part of a larger cooking apparatus, such as a stove or a commercial cooking unit.

BACKGROUND OF THE INVENTION

Conventional cooktops are quite dangerous, particularly for young children. Normally, there is nothing to prevent a child standing on a floor surface in front of a cooktop, from reaching up and over the front edge of the cooking surface, and possibly touching one of the heating units or a utensil that is being heated. Worse still, there is a risk that a child might grasp, say, a handle of a saucepan and pull the saucepan down. For adults too, there is a risk of accidentally knocking or pulling a saucepan off the cooking surface or upsetting the saucepan and spilling its contents off the cooktop.

Most counter tops are designed with the top surface of the counter top at a standard height above floor level (36" in North America). Probably as a consequence of this, most cooktops are located with the cooking surface at counter top level, even where the cooktop forms part of a stove or other cooking apparatus. While this standard height may be the optimum for a person working at a counter top, it is often inconveniently high for cooking. Accordingly, it is not an option to raise the height of the cooking surface.

Proposals have been made to provide of a cooktop with a protective "fence" which is separate from the cooktop itself. For example, a device of this type is available from Kessbeb öhmer of Bad Essen, Germany under the name "Child Safeguard". This device essentially comprises a wire frame that surrounds the cooking surface and that includes a "fence" formed by a horizontal series of vertically spaced bars across the front of the cooking surface. At the back of the frame, an upward wire extension of inverted U-shape lies against the wall behind the cooking surface and is retained against the wall, as some measure of protection against accidental displacement of the unit from its protective position. When the "fence" is not required, the frame can be folded up against the wall behind the cooktop.

While this product does represent an improvement as compared with a completely unprotected cooking surface, it is not an ideal solution. The protective "fence" is not a permanent fixture and, therefore, may not be in place when it is required most. Also, there is some risk that the frame could accidentally be displaced from its protective position and thereby become ineffective. Further, this prior art device does not provide any protection against spillage of hot food or other material from a cooking utensil on the cooking surface.

SUMMARY OF THE INVENTION

It is an object of the present invention to provide improvements which are intended to address these shortcomings of the prior art.

Accordingly, the invention provides a food cooking apparatus which includes a cooktop comprising a cooking surface provided with at least one heating unit, wherein the cooking surface is located in a well defined by said surface and at least one wall which extends across a front side of the cooking surface and above said surface and which has a height selected to provide a barrier preventing direct access to said surface.

By locating the cooking surface in a well in accordance with the with invention, not only is a child protected by the wall at the front of the well from touching the heating unit or units, but the wall also prevents a saucepan or other utensil being pulled off the cooking surface. Also, the well itself tends to retain any food or other liquid that might be spilled on the cooking surface, providing protection for adults as well as children.

Preferably, the well is defined by walls extending not only along the front side of the cooking surface but also along a rear side, and both ends. In other words, the cooking surface is preferably completely surrounded so that there can be no spillage of liquid from the well. In a particular preferred embodiment, the well is a fabrication in stainless steel.

The cooktop preferably is positioned with the top edge of the front wall (and any rear or side walls) at counter top height (i.e. 36" above floor level in North America). The cooking surface itself is then located an amount below counter top level corresponding to the height of the wall(s). Typically, the wall(s) have a height of approximately 3" (8 cm). In other words, the cooking surface will then be located at 33" above floor level. It has been found that this is a more convenient height for a cooking surface and is ergonomically more acceptable than a 36" high cooking surface.

BRIEF DESCRIPTION OF DRAWINGS

In order that the invention may be more clearly understood, reference will now be made to the accompanying drawings which illustrate a particular preferred embodiment of the invention by way of example, and in which:

FIG. 3 is a front elevational view corresponding to FIG. 1;

FIG. 4 is a sectional view on line 4—4 of FIG. 2; and,

FIG. 5 is a rear elevational view corresponding to FIG. 1.

DESCRIPTION OF PREFERRED EMBODIMENT

Figure 1:
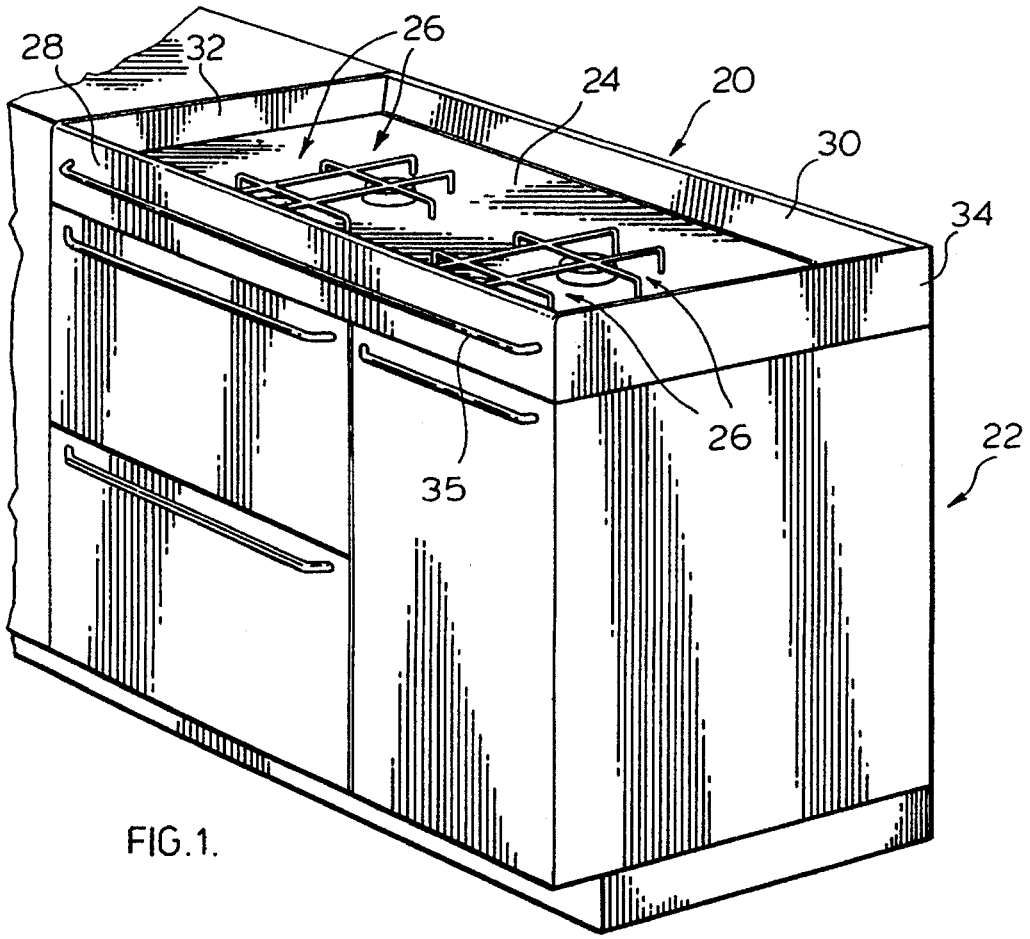
FIG. 1 is a perspective view from one end and above of a food cooking apparatus which incorporates a cooktop in accordance with the invention.

Referring first to FIG. 1, a cooking apparatus is shown to comprise a cooktop 20 and a custom built kitchen cabinet 22 on top of which the cooktop is installed. The cooktop includes a cooking surface 24 and four conventional heating units which are individually denoted 26. The heating units may be conventional units of any appropriate type and have therefore been shown schematically only.

As can clearly be seen from FIG. 1, the cooking surface 24 is located in a well defined by said surface, a wall 28 which extends along a front side of the surface, a wall 30 which extends along the rear side, and two end walls 32 and 34. In this particular embodiment, the well is a onepiece fabrication in stainless steel (see later). A handle on the front wall of 10 the well is indicated at 35.

FIG. 3 shows at 36 a child standing in front of the cooking apparatus 20 and illustrates the fact that the front wall 28 of the cooktop provides a barrier preventing direct access to the cooking surface 24. The height of the wall 28 will be selected so that the barrier is of adequate height without making the cooking surface 24 too low. As noted previously, the wall may have a height above the cooking surface (h—see FIG. 4) of approximately 3" or 8 cm.

Figure 2:
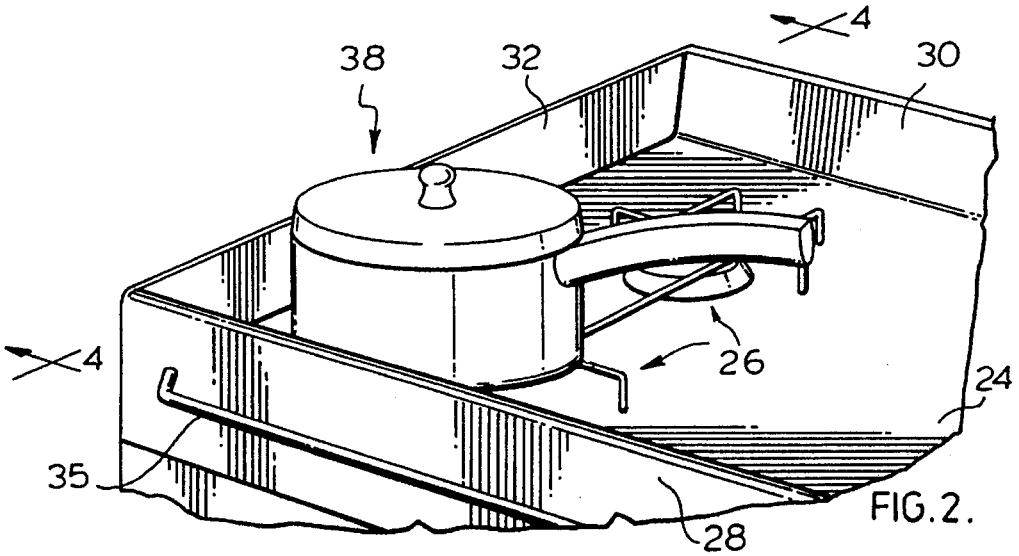
FIG. 2 is a detail perspective view of the left hand end portion of the cooktop shown in FIG. 1.

In a minimum case, it may be that a cooking surface provided with a front wall only would be adequate where the primary concern is to prevent access by a child to the cooking surface and/or heating units. Preferably, however, the well which includes the cooking surface has a wall that completely surrounds the surface, as in the illustrated embodiment. FIG. 2 in particular illustrates chat, where there is a complete well, cooking utensils, such as the saucepan 38 are effectively "trapped" on the cooking surface and virtually prevented from being accidentally dislodged. Even if a cooking utensil is upset, anything that is spilled will not flow off the cooking surface.

FIG. 4 is a cross-sectional view on line 4—4 of FIG. 2 and serves to illustrate the structure of the well comprising the cooking surface 24 and the four perimeter walls 28, 30, 32 and 34. The cooking surface and the front and rear walls 28 and 30 are made in one piece from a section of stainless steel that is formed to have the cross-sectional shape shown in FIG. 4. In that view, the section of stainless steel is denoted by reference numeral 40 and has been folded to form the cooking surface 24 and the front and rear walls 28 and 30 respectively, as one piece. It will be seen that the front wall 28 has a sloping inner surface 28*a* and a generally vertical outer surface 28*b* with an inturned lip 28*c* at its lower end. The rear wall 30 on the other hand has a sloping inner surface 30*a* with horizontal flange 30*b* at the top, but no vertical outer wall portion.

The end walls 32 and 34 are plain flat sheets of stainless steel to which the end edges of section 40 are welded, to form a one-piece fabrication. Holes 42 are drilled through the bottom marginal portion of each of the end walls 32 and 34 below the cooking surface 24 to provide a means for attaching the cooktop to a cabinet.

The cabinet itself (reference numeral 22 in FIG. 1) is essentially of conventional construction and is shaped at the top to provide a surface, such as that indicated generally at 22*a* in FIG. 4, on which the cooktop can be stably supported. Screws are then driven through the holes 42 in the end walls to secure the cooktop to the cabinet. The outer ends of the screw holes are countersunk.

It will of course be understood that the preceding description relates to a particular preferred embodiment of the invention only and that the invention is not limited to the precise embodiment shown in the drawings. As indicated previously, the cooktop of the invention need not be a separate unit that is supported on a base cabinet but could be incorporated as an integral part of a stove or other cooking apparatus (whether domestic or commercial). Also as noted previously, while the cooking surface preferably is surrounded by four walls, in a minimum situation, a wall may be provided at the front of the cooking surface only.

I claim:

1. Food cooking apparatus comprising a kitchen cabinet and a cooktop installed on and secured to the cabinet, the cooktop comprising a cooking surface provided with at least one heating unit, wherein the cooking surface is located in a well defined by said surface, a wall which extends across a front side of the cooking surface and above said surface and which has a height selected to provide a barrier preventing direct access to said surface from the front; a rear wall which extends along a rear side of the cooking surface, and end walls extending between the front wall and the rear wall at opposite ends of the cooking surface, whereby the cooking surface is completely surrounded by said walls; wherein said well comprising said cooking surface, said front wall, said rear wall and said end walls is a one-piece fabrication comprising a single section formed to define said cooking surface and said front and rear walls, and respective plain sections secured to opposite ends of said formed section, for providing said end walls.

2. Food cooking apparatus as in claimed in claim 1, wherein said cabinet is dimensioned so that a top edge of said at least one wall which extends across the front side of the cooking surface is disposed at a standard counter top height above a floor surface on which the cabinet is disposed, whereby said cooking surface is located below said standard counter top height.

3. Food cooking apparatus as claimed in claim 1, wherein said sections of the fabrication are stainless steel.

* * * * *